US005601454A

United States Patent [19]

Suzuki et al.

[11] Patent Number: 5,601,454

[45] Date of Patent: Feb. 11, 1997

[54] METHOD OF AND CONSTRUCTION FOR DETECTING DEFECT IN LANCE

[75] Inventors: Kenya Suzuki; Shinji Kodama, both of Shizuoka, Japan

[73] Assignee: Yazaki Corporation, Tokyo, Japan

[21] Appl. No.: 502,058

[22] Filed: Jul. 14, 1995

[30] Foreign Application Priority Data

Jul. 14, 1994 [JP] Japan ..... 6-162271

[51] Int. Cl.[6] ..... H01R 13/40

[52] U.S. Cl. ..... 439/595; 29/705

[58] Field of Search ..... 439/595; 29/705, 29/593, 892

[56] References Cited

U.S. PATENT DOCUMENTS 4,969,841 11/1990 Sueyoshi et al. ..... 439/595
5,393,248 2/1995 Yagi et al. ..... 439/595
5,455,515 10/1995 Saijo et al. ..... 439/595
5,467,023 11/1995 Takeyama ..... 29/593

*Primary Examiner*—Neil Abrams
*Assistant Examiner*—Barry Matthew L. Standig
*Attorney, Agent, or Firm*—Sughrue, Mion, Zinn, Macpeak & Seas

[57] ABSTRACT

In a lance defect detection construction, if a lance lacks a beak at its distal end because of defective molding, the lance can not be displaced by a distal end of a terminal. In such a case, an insertion prevention surface, which is so arranged as to interfere with a retaining piece portion of the terminal, formed on a rear edge of each of side beaks formed respectively on opposite side surfaces of the lance, abuts against a front edge of the associated retaining piece portion, thereby hindering the insertion of the terminal into a terminal receiving chamber 1. As a result, the terminal is held not in a pseudo-retained condition but in an clearly incompletely-inserted condition, so that a molding defect in the lance can be easily detected.

5 Claims, 3 Drawing Sheets

METHOD OF AND CONSTRUCTION FOR DETECTING DEFECT IN LANCE

BACKGROUND OF THE INVENTION

The present invention relates to a method and a construction capable of detecting a molding defect in an elastic lance formed within a terminal receiving chamber of a connector when a terminal is inserted into the terminal receiving chamber, and more particularly to such method and construction for detecting a molding defect in the lance by hindering the insertion of the terminal.

Usually, a terminal inserted into a terminal receiving chamber in a connector housing is retained in a double manner so that the terminal can be positively retained against rearward withdrawal.

As shown in FIG. 4, an elastic lance 3 in the form of a retaining arm is provided within a terminal receiving chamber 1, and is integrally connected at its proximal end to a connector housing, a distal end of the lance 3 being free. The distal end portion of the lance 3 projects into the terminal receiving chamber 1, and a projection or beak 5 is formed on the distal end of the lance 3, and projects into the terminal receiving chamber 1. The beak 5 serves as retaining means for retaining a terminal 9 in the terminal receiving chamber 1.

A pair of side beaks 7 are formed on opposite side surfaces of the lance 3, respectively, and each side beak 7 has a front vertical abutment surface 7*a*, and a gently-slanting surface 7*b* at a lower side thereof.

The terminal 9 to be inserted into the terminal receiving chamber 1 includes a plate-like or pin-like electrical contact portion 11 at its front end, and a tubular base portion 13 provided rearwardly of the electrical contact portion 11. A retaining hole 15 is formed in that portion of the base portion 13 that can face the lance 3, and the beak 5 of the lance 3 is engageable in this retaining hole 15. A pair of retaining piece portions 17 are formed at opposite sides of the retaining hole 15, respectively. The retaining piece portions 17 are formed, for example, by raising stamped-out portions formed as a result of the formation of the retaining hole 15.

In such a terminal double-retaining construction, when the terminal 9 is inserted into the terminal receiving chamber 1, the electrical contact portion 11 advances in sliding contact with the beak 5 to urge or flex the beak 5 to thereby flex the lance 3 away from the bottom of the terminal receiving chamber 1. At this time, the side beaks 7 are also displaced away from the bottom of the terminal receiving chamber 1 beyond the retaining piece portion 17.

Then, when the retaining hole 15 in the terminal 9 reaches the beak 5, the lance 3 is elastically restored, so that the beak 5 is engaged in the retaining hole 15, and also the abutment surfaces 7*a* of the side beaks 7 are engaged with rear edges of the retaining piece portions 17, respectively, thus completing the double retaining of the terminal 9.

In the molding of the connector housing having the integral lance 3, if the filling of a molding material (synthetic resin) in a mold is affected for some reason, the synthetic resin fails to be fully filled up to an extremity of a mold cavity, so that the resultant molded product may be defective in that it lacks a distal end portion.

In such a case, the lance 3 does not have the beak 5 as shown in FIG. 6, and therefore upon insertion of the terminal 9, the electrical contact portion 11 can not contact the beak 5 of the lance 3, and hence the lance 3 can not be displaced.

In the conventional double-retaining terminal construction, however, even if the lance 3 has such molding defect, the terminal is retained in position within the terminal receiving chamber by the side beaks 7, as shown in FIG. 7. Thus, even without the beak 5 at the distal end of the lance 3, the retaining piece portions 17 of the inserted terminal 9 advance in sliding contact with the slanting surfaces 7*b* of the respective side beaks 7 to urge the side beaks 7 upward. As a result, the retaining piece portions 17 are retained by the side beaks 7 in a normal condition (see FIG. 5).

In such a retained condition in which the terminal is retained only by the side beaks 7, the retaining strength is much lower than in the double-retained (or completely-retained) condition. The result is that upon application of an external force to the terminal 9, the terminal 9 can be easily withdrawn.

However, it is very difficult to find such a defective connector, having the terminal held in a pseudo-retained condition, at a later stage.

SUMMARY OF THE INVENTION

The present invention has been made in view of the above problems, and an object of the invention is to provide a method of and a construction for detecting a defect in a lance, by which the defective lance can be easily detected when inserting a terminal into a connector housing.

The above object has been achieved by a method of detecting a defect in a lance wherein a defect in the lance, projected into a terminal receiving chamber in a connector housing, is detected by inserting a terminal into the terminal receiving chamber; that is, when a distal end portion of the lance is not displaced by the terminal inserted into the terminal receiving chamber, the insertion of the terminal into the terminal receiving chamber is hindered by a side beak, formed on a predetermined portion of the lance, thereby detecting a defect in the distal end portion of the lance.

Further, the above object also has been achieved by a construction for detecting a defect in a lance wherein a defect in the lance, projected into a terminal receiving chamber in a connector housing, is detected by inserting a terminal into the terminal receiving chamber; that is, when a distal end portion of the lance is not displaced by the terminal inserted into the terminal receiving chamber, a side beak, formed on a side surface of the lance, abuts against a retaining piece portion, formed on a predetermined portion of the terminal, to hinder the insertion of the terminal, thereby detecting a defect in the distal end portion of the lance.

In the lance defect detection method according to the present invention, if the lance is not elastically deformed away from the bottom of the terminal receiving chamber because of a molding defect in the distal end portion of the lance when the terminal is inserted into the terminal receiving chamber, the side beak can not be displaced into a position where the side beak does not interfere with the retaining piece portion of the terminal, and hence the side beak abuts against the retaining piece portion, thereby hindering a further insertion of the terminal. As a result, the terminal is clearly held in an incompletely-inserted condition, so that the defective molding of the lance can be easily detected.

In the lance defect detection construction, if the lance is not elastically deformed away from the bottom of the terminal receiving chamber because of a molding defect in the distal end portion of the lance when the terminal is inserted into the terminal receiving chamber, the insertion prevention surface of the side beak interferes with the retaining piece portion of the terminal. With this construction, the insertion of the terminal is hindered, so that a defect in the lance can be easily detected.

DETAILED DESCRIPTION OF THE INVENTION

Figure 1:
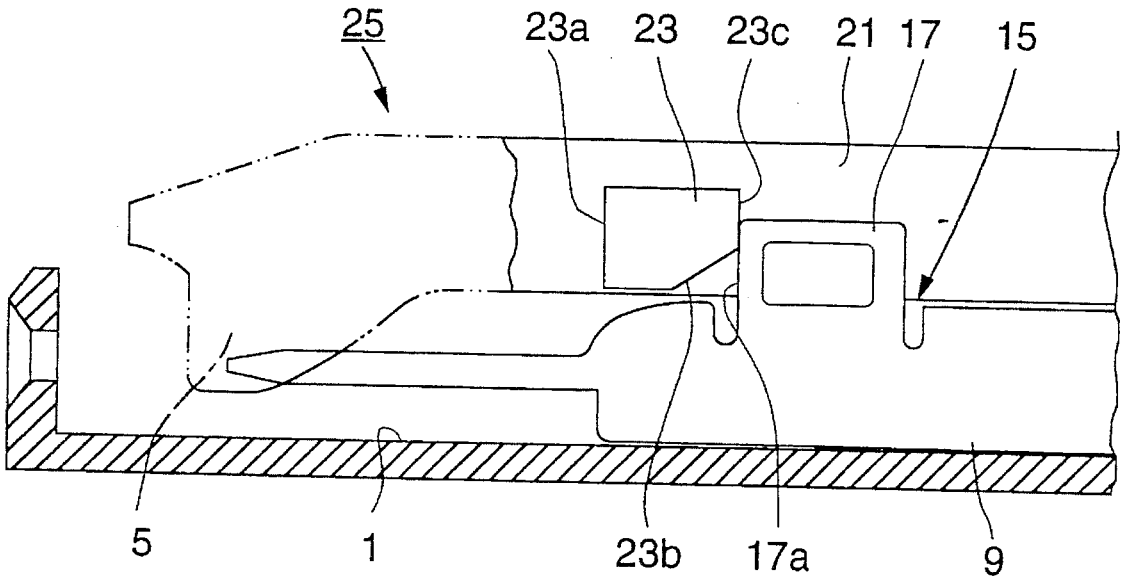
FIG. 1 is a cross-sectional view of an embodiment of a lance defect detection construction of the present invention.
Figure 2:
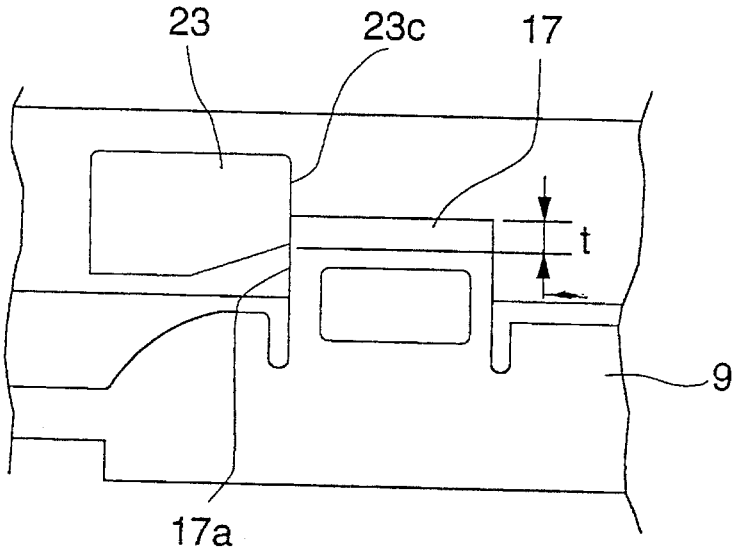
FIG. 2 is an enlarged view of an important portion of the construction of FIG. 1.
Figure 3:
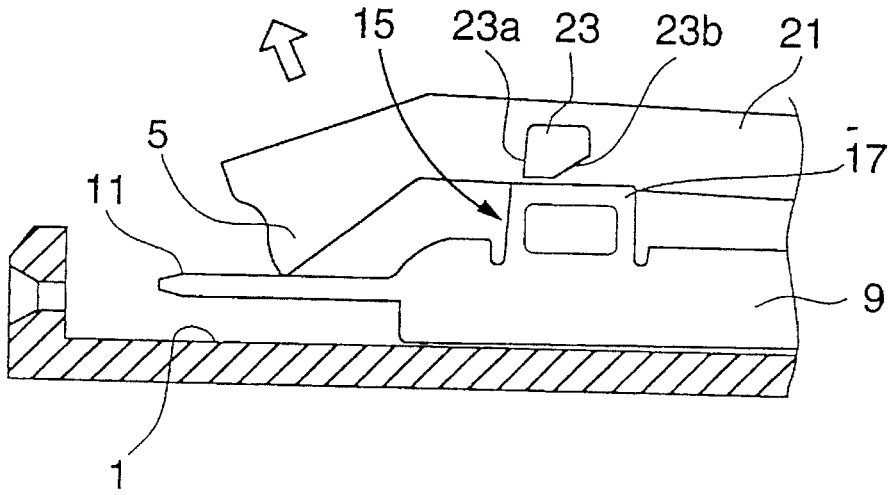
FIG. 3 is a cross-sectional view showing a proper lance in an inserted condition of a terminal.
Figure 4:
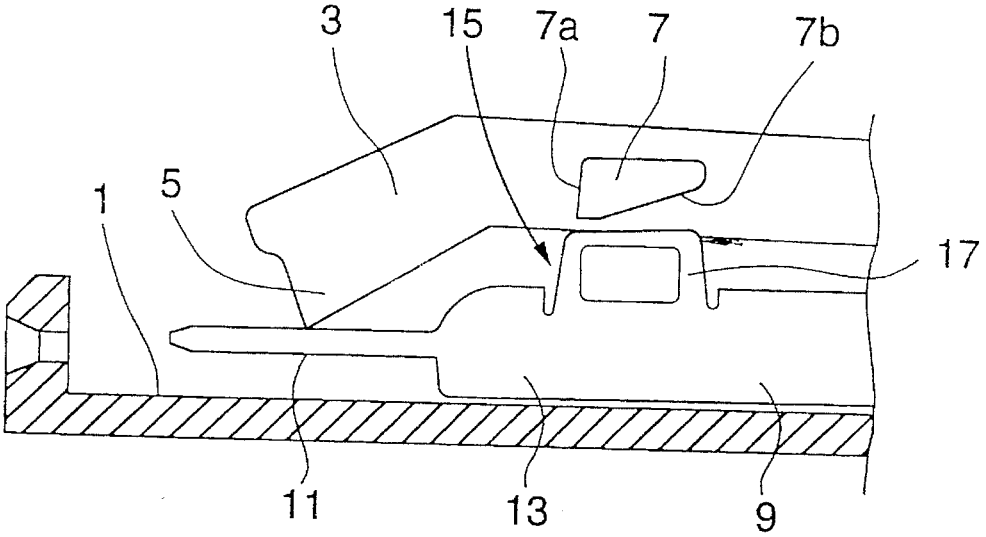
FIG. 4 PRIOR ART
FIG. 4 is a cross-sectional view of a terminal retaining construction in a conventional connector.
Figure 5:
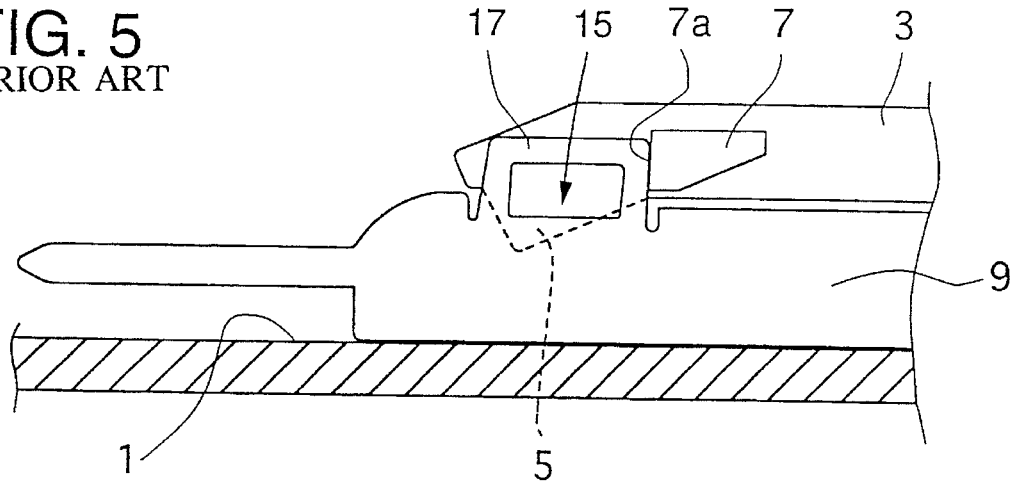
FIG. 5 PRIOR ART
FIG. 5 is an enlarged view of an important portion of the connector of FIG. 4, showing a double-retained condition of a terminal.
Figure 6:
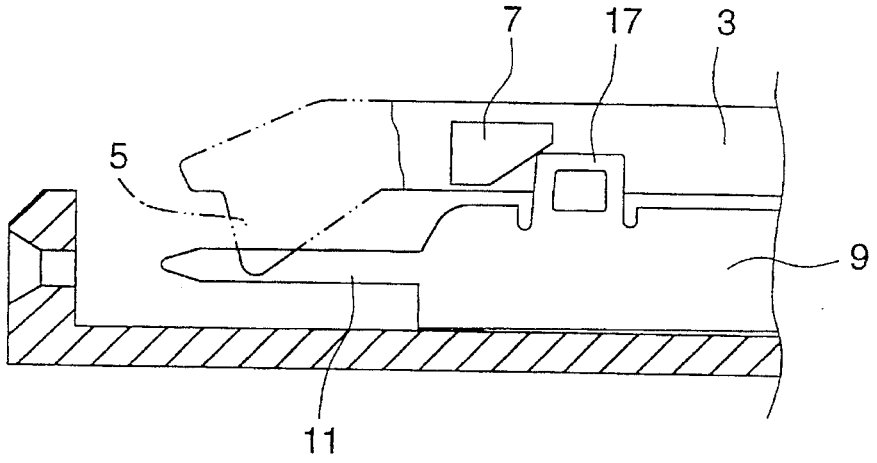
FIG. 6 is cross-sectional view showing a defective conventional lance in an inserted condition of the terminal.
Figure 7:
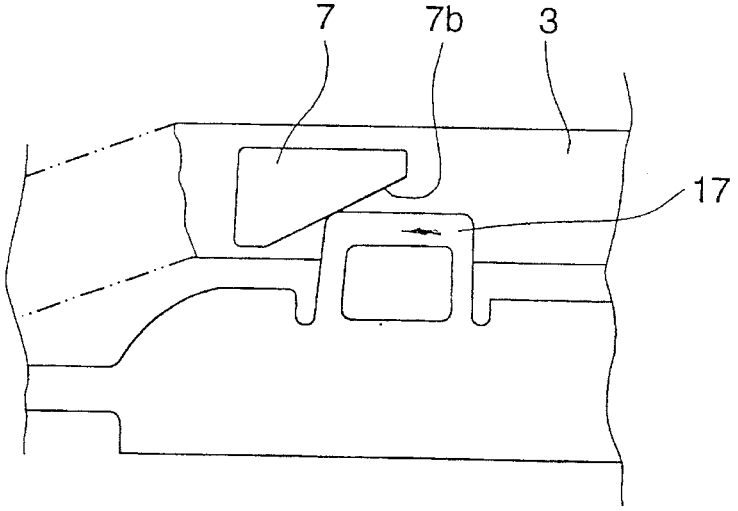
FIG. 7 is an enlarged view of an important portion of the connector of FIG. 6.

A method of and a construction for detecting a defect in a lance, provided in accordance with a preferred embodiment of the present invention, will now be described with reference to FIGS. 1 to 3. FIG. 1 is a cross-sectional view showing a lance defect detection construction of the embodiment of the invention, FIG. 2 is an enlarged view of an important portion of the construction of FIG. 1, and FIG. 3 is a cross-sectional view showing a proper lance structure. In these Figures, those portions identical to those of the construction of FIG. 4 will be denoted by identical reference numerals, respectively, and explanation thereof will be omitted.

As shown in FIG. 1, a pair of plate-like side beaks (or bulged portions) 23 are formed on and project from opposite side surfaces of an elastic lance (or retaining piece portion) 21 of the cantilever type, respectively. Here, a distal end of the lance 21 is directed toward a front side whereas a proximal end thereof is directed toward a rear side. A front end surface of the side beak 23 defines an abutment surface 23*a* perpendicular to the longitudinal axis of the lance 21. A slanting surface 23*b* is formed on a lower surface of the side beak 23, and is slanting rearwardly away from a terminal receiving chamber 1. A rear end surface of the side beak 23 defines an insertion prevention surface 23*c* perpendicular to the longitudinal axis of the lance 21.

The relation between the side beak 23 and an associated retaining piece portion 17 during the insertion of a terminal 9 into the terminal receiving chamber 1 will now be described.

As shown in FIG. 3, the slanting surface 23*b* of each side beak 23 is so positioned that it will not interfere with the associated retaining piece portion 17 of the terminal 9 when the lance 21 is flexed during the insertion of the terminal 9 into the terminal receiving chamber 1. The abutment surface 23*a* of the side beak 23 is so positioned that it can be retained by a rear edge of the associated retaining piece portion 17 when a beak 5 is engaged in a retaining hole 15.

As shown in FIG. 2, the insertion prevention surface 23*c* of the side beak 23 is so positioned that it can overlap a front edge 17*a* of the retaining piece portion 17 by an amount t when the terminal 9 is inserted without flexing the lance 21. Namely, when the terminal 9 is inserted without flexing the lance 21, the insertion prevention surface 23*c* serves as a stopper surface for preventing the insertion of the terminal 9.

The operation of this lance defect detection construction 25 will now be described.

As shown in FIG. 3, when the terminal 9 is inserted into the terminal receiving chamber 1, the beak 5 of the lance 21 is brought into sliding contact with an electrical contact portion 11 of the terminal 9, and the lance 21 is flexed away from the bottom of the terminal receiving chamber 1 as indicated by an arrow in FIG. 3. At this time, the slanting surface 23*b* of each side beak 23 does not interfere with the associated retaining piece portion 17 of the terminal 9, and the side beak 23 is moved into a retracted position in accordance with the insertion of the terminal 9. When the retaining hole 15 in the terminal 9 reaches the beak 5, the lance 21 is elastically restored, so that the beak 5 is engaged in the retaining hole 15, and at the same time the abutment surface 23*a* of each side beak 23 is retained by the associated retaining piece portion 17, thus completing the double retaining of the terminal 9.

There are occasions when the lance 21 fails to be flexed away from the bottom of the terminal receiving chamber 1 because of lack of the distal end or beak 5 of the lance 21 (see FIG. 1). In such a case, when the terminal 9 is inserted into the terminal receiving chamber 1, the side beaks 23 can not be moved into their respective retracted positions, and the front edge 17*a* of each retaining piece portion 17 is abutted against the insertion prevention surface 23*c* of the associated side beak 23, thereby preventing a further insertion of the terminal 9 into the terminal receiving chamber 1.

Thus, the terminal 9 is clearly held in an incompletely-inserted condition, and is not held in an pseudo-retained condition which can not be easily distinguished from the completely-retained condition. Therefore, a defect in the lance 21 can be easily detected.

In the above embodiment, although the invention has been applied to the connector having the terminal with the male electrical contact portion, similar operation and effects as described above can be achieved also with respect to a terminal with a female electrical contact portion.

In the above embodiment, although the pair of side beaks are formed on the opposite side surfaces of the lance, respectively, such side beak may be formed on only one of the opposite side surfaces of the lance.

As described above, in the lance defect detection method of the present invention, if there is a molding defect in the distal end portion of the lance, the insertion of the terminal into the terminal receiving chamber is hindered, so that the terminal is held not in a pseudo-retained condition but in a clearly incompletely-inserted condition. Therefore, a defect in the lance can be easily detected, and such defective connectors are positively prevented from being joined to the proper connectors, thus enhancing the reliability of the products.

In the lance defect detection construction of the present invention, if there is a molding defect in the distal end portion of the lance, the insertion prevention surface of the side beak interferes with the retaining piece portion of the terminal. With this construction, the insertion of the terminal is hindered, thereby detecting a defect in the lance. Thus, by slightly modifying the configuration and positional relation of the conventional parts, the detection construction can be provided at very low costs.

What is claimed is:

1. A lance defect detection method of detecting a defect in a lance projected into a terminal receiving chamber in a connector housing, comprising the steps of:

inserting a terminal into said terminal receiving chamber; and hindering insertion of said terminal into said terminal receiving chamber by a side beak formed on a side surface of said lance, when a distal end portion of said lance is not displaced by said terminal inserted into said terminal receiving chamber, thereby detecting a defect in said distal end portion of said lance.

2. A lance defect detection method according to claim 1, wherein a defect in molding of said lance is detected through interference of said side beak with a retaining piece portion formed on said terminal.

3. A lance defect detection construction for detecting a defect in a lance projected into a terminal receiving chamber in a connector housing through insertion of a terminal into said terminal receiving chamber, comprising:

a side beak formed on a side surface of said lance; and a retaining piece portion formed on said terminal;

wherein when a distal end portion of said lance is not displaced by said terminal inserted into said terminal receiving chamber, said side beak abuts against said retaining piece portion to hinder insertion of said terminal, thereby detecting said defect in said distal end portion of said lance.

4. A lance defect detection construction according to claim 3, wherein said side beak projects from a side surface of said lance in a direction perpendicular to a longitudinal axis of said lance, and an insertion prevention surface of said side beak that can abut against said retaining piece portion is formed at a rear end of said side beak.

5. A lance defect detection construction according to claim 3, wherein when said distal end portion of said lance is not displaced by said terminal inserted into said terminal receiving chamber, said side beak is partially abutted against a front edge of said retaining piece portion.

* * * * *